US005112242A

United States Patent [19]

Choy et al.

[11] Patent Number: 5,112,242

[45] Date of Patent: May 12, 1992

[54] DURABLE LATCH FOR MEMORY MODULE BOARD

[75] Inventors: Conrad Y. Choy, San Francisco; Jack Yu, Sunnyvale, both of Calif.

[73] Assignee: Foxconn International, Inc., Sunnyvale, Calif.

[21] Appl. No.: 615,987

[22] Filed: Nov. 20, 1990

[51] Int. Cl.[5] ..... H01R 13/62

[52] U.S. Cl. ..... 439/326; 439/328

[58] Field of Search ..... 439/152-160, 439/326-329, 59-62, 631-637

[56] References Cited

U.S. PATENT DOCUMENTS

| | | | |
|---|---|---|---|
| Re. 29,780 | 9/1978 | Rutkowski | 439/358 |
| 1,616,654 | 2/1927 | Gammetu | 439/358 |
| 4,057,879 | 11/1977 | Eigenbrode | 439/358 |
| 4,203,643 | 5/1980 | Krolak et al. | 439/353 |
| 4,713,013 | 12/1987 | Regnier et al. | 439/62 |
| 4,737,120 | 4/1988 | Grabbe et al. | 439/326 |
| 4,740,164 | 4/1988 | Schulz et al. | 439/152 |
| 4,806,118 | 2/1989 | Herrmann | 439/352 |
| 4,850,891 | 7/1989 | Walkup et al. | 439/327 |
| 4,850,892 | 7/1989 | Clayton et al. | 439/326 |
| 4,898,540 | 2/1990 | Saito | 439/153 |
| 4,986,765 | 1/1991 | Korsunsky et al. | 439/326 |
| 4,995,825 | 2/1991 | Korsunsky et al. | 439/328 |
| 5,002,498 | 3/1991 | Takahashi | 439/326 |

OTHER PUBLICATIONS

"Micro-Edge Simm Connectors with Metal Latches", AMP Product Information Bulletin, 1990, Harrisburg, PA.

*Primary Examiner*—David L. Pirlot

*Attorney, Agent, or Firm*—Flehr, Hohbach, Test, Albritton & Herbert

[57] ABSTRACT

An inherently resilient metallic latch structure is provided for use in connection with a socket structure for a memory module board. The latch structure is separately manufacturable from the socket structure, and is applied thereto in a separate operation, and is effective to retain the memory module board against inadvertent release from the socket. For intentional release of the memory module from the socket, the latch requires only a downwardly directed force to be applied to a latch lever forming an integral part of the latch to impose a bending moment on the latch, effectively releasing the memory module board from the socket and permitting resilient ejection of the board from the socket. In a second aspect, the latch is integrally formed with the socket body, but includes an integral latch lever that may be depressed by application of a downwardly directed force to impose a bending moment on the latch to release the memory module board from the socket.

25 Claims, 5 Drawing Sheets

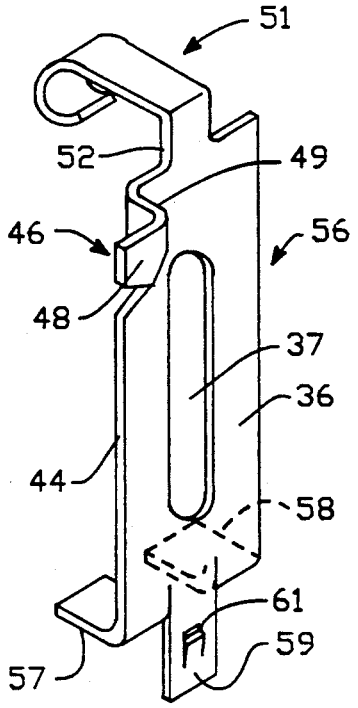
FIG.—12
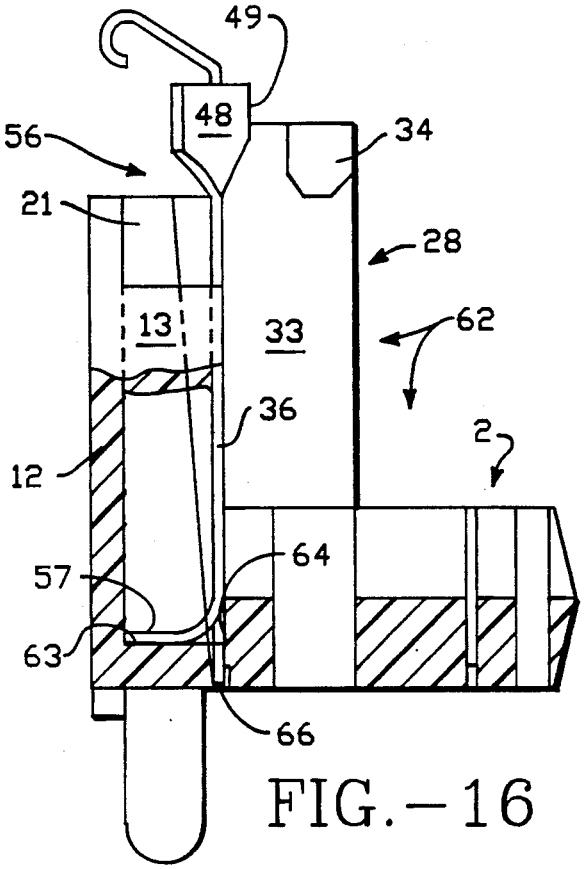
FIG.—16
FIG.—13
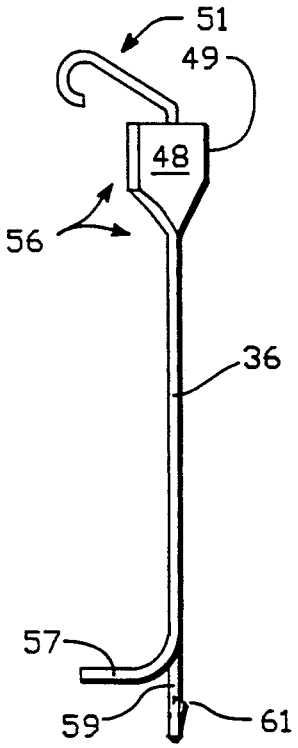
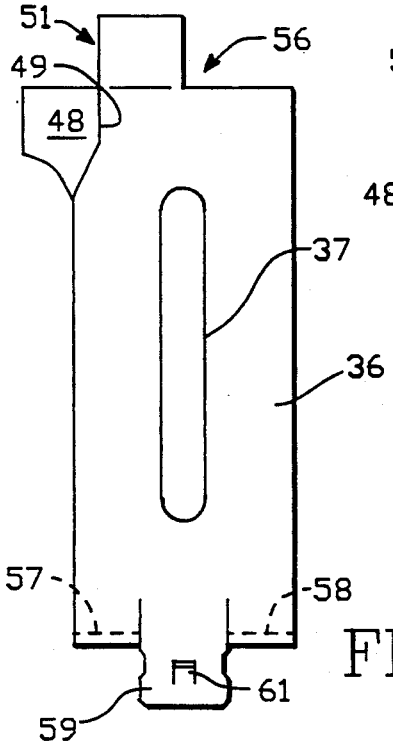
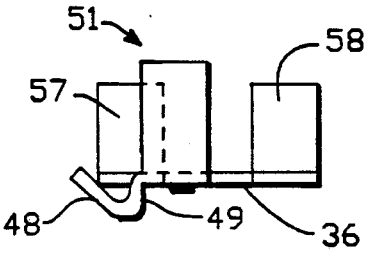
FIG.—15
FIG.—14

DURABLE LATCH FOR MEMORY MODULE BOARD

BACKGROUND OF THE INVENTION

1. Field of the Invention

The present invention relates to electrical connectors, and more particularly to a durable and reliable latch for releasably securing a single in-line memory module or board to its associated connector.

2. Description of the Prior Art

The known prior art relating to this invention include U.S. Pat. Nos. 4,713,013; 4,737,120; 4,832,617; 4,850,891 and 4,850,892.

It is noted that U.S. Pat. No. 4,832,617 is owned by the assignee of the present invention. The subject matter of the present invention in one aspect, constitutes an improvement over the structure disclosed and claimed in U.S. Pat. No. 4,832,617 in that the reference patent included a latch structure that was integrally molded with the socket adapted to receive the memory module, with release of the memory module requiring flexure of the plastic latch member. Experience has indicated that even though means were provided in U.S. Pat. No. 4,832,617 to prevent over stressing of the plastic molded latch member by restricting the degree of its displacement, the greater problem is in effecting displacement of the molded latch member to a degree sufficient to release the memory module because of inaccessability of the latch member to the imposition of a release force. Accordingly, one of the important objects of the invention is the provision of a connector member incorporating a latch that is actually from above to release the memory module by application of a downwardly directed force on a latch lever to impose a bending moment on the latch body.

Another important object of the present invention is the incorporation into a connector member for receiving a memory module of a latch member fabricated from an appropriate inherently resilient metallic material.

Yet another object of the invention is the provision of a inherently resilient metal latch member that may be manufactured apart from the connector member and mounted thereon in a separate operation to provide a durable and long lasting latch structure for the reliable and releasable retention of a memory module in the associated socket of the connector member.

Still another object of the invention is the provision of a latch member for a memory module that is economical to manufacture and reliable in its association with the connector member so as to properly position the memory module in the connector.

Because connectors of the type that receive memory modules frequently incorporate resilient contact members that are delicate, it is important that very little or zero force be required to insert the memory module in the connector member, while providing means for reliably retaining the memory module positively connected to the resilient contacts of the connector member after it is inserted. Accordingly, it is another object of the present invention to provide an inherently resilient metallic latch member that incorporates a locking tab that prevents inadvertent release of the memory module from the connector member in which it is mounted.

Experience has taught that memory module differ somewhat in their width and length dimensions due to failure to meet specification tolerances. Accordingly, a still further object of the present invention is the provision of an inherently resilient metal latch structure in combination with a connector member for a memory module that will accept and lock in appropriate position in the connector member memory modules of varying length and width.

It frequently happens that a connector member for a memory module must be mounted on a printed circuit board in an alternate position. Accordingly, a still further object of the present invention is the provision of an inherently resilient metallic latch member that may be accommodated in a connector member in an alternate position to thereby facilitate insertion of a memory module in an alternate position and reliably retain the board in such alternate position while providing the facility for releasing the memory module when necessary.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, this invention in one aspect relates to an inherently resilient metallic latch structure considered as an article of manufacture, and in a second aspect, the combination of such separately manufacturable inherently resilient metallic latch structure with a synthetic resinous injection molded connector block or member adapted to receive in operative relationship a single in-line memory module or board which when inserted is reliably retained in operative position in the connector member in a manner to prevent inadvertent release of the single in-line memory module while permitting intentional removal of the memory module from the connector without destruction of the connector or the memory module, and without having to remove adjacent memory modules. Structurally, in one aspect of the invention, the connector block or member is fabricated from synthetic resinous material with a nacelle formed at each end adapted to receive an inherently resilient metallic latch member in a manner that locks the latch member to the connector block or member. The resilient latch is mounted at each end of the connector member in a manner to lockingly engage the memory module to prevent its inadvertent removal from the socket member while enabling selective removal of the memory module without the necessity of disturbing adjacent memory modules. Such locking means comprises a resilient tab that projects laterally from the latch member and which provides a camming surface against which during insertion the end edges of the memory module impinge to resiliently flex the latch tab sufficiently to permit seating of the memory module behind the latch tab. The latch tab is provided with an abutment or lock surface that is parallel to the face of the memory module and which contiguously abuts such memory module surface to reliably retain the memory module in locked and operative position with respect to the connector member. In another aspect of the invention, the latch member is molded integrally with the connector member. In both aspects of the invention a latch lever is provided by which a downwardly directed force may be applied to effect release of the memory module.

BRIEF DESCRIPTION OF THE DRAWINGS

FIG. 12 is a perspective view of another embodiment of the metallic latch member shown apart from the connector body.

FIG. 13 is an edge elevational view of the metallic spring latch member illustrated in FIG. 12.

FIG. 14 is a front elevational view of the spring latch member taken in the direction indicated by the arrow 14 in FIG. 13.

FIG. 15 is a plan view of the spring latch member illustrated in FIG. 14.

FIG. 16 is a fragmentary elevational view similar to FIG. 5 but showing the latch member embodiment illustrated in FIG. 12 mounted in the left end portion of a connector member. Portions of the structure are broken away to reveal underlying parts.

DESCRIPTION OF THE PREFERRED EMBODIMENT

In terms of greater detail, one of the purposes of the present invention is to solve the problem of insertion and extraction of very closely spaced memory modules in connectors that are mounted on a printed circuit board in close side-by-side or end-to-end relationship. The constraints of space in a finished computer product has required that the connectors for memory modules possess as small a "footprint" as possible, and that such connector members be arranged on a printed circuit board so that a maximum number of such connector members may be mounted on a circuit board of given dimensions. That inevitably requires that the connector members be mounted in close side-by-side and end-to-end relationship, and it inevitably results in difficulty in extracting one memory module from a connector that is nestled within the closely spaced ranks of surrounding connector members.

To obviate this problem, the subject matter of this invention, in one of its aspects, utilizes a connector member designated generally by the numeral 2, and which is preferably injection molded from an appropriate electrically insulative synthetic resinous material. The connector member is elongated in its configuration as illustrated in U.S. Pat. No. 4,832,617, and includes a central body portion designated generally by the numeral 3 and having a longitudinal socket slot 4 within which the contact edge of a memory module (not shown) is resiliently received. Along its length, transversely extending slots are provided adapted to receive appropriate resilient contacts (not shown) arranged to make electrical contact with the contact edge pads of the memory module when inserted into the socket slot and lockingly mounted in the connector member. In the interest of brevity in this description, the central elongated portion of the connector member is neither illustrated nor described, but the structure and description thereof is incorporated hereat by reference to U.S. Pat. No. 4,832,617.

Figure 1:
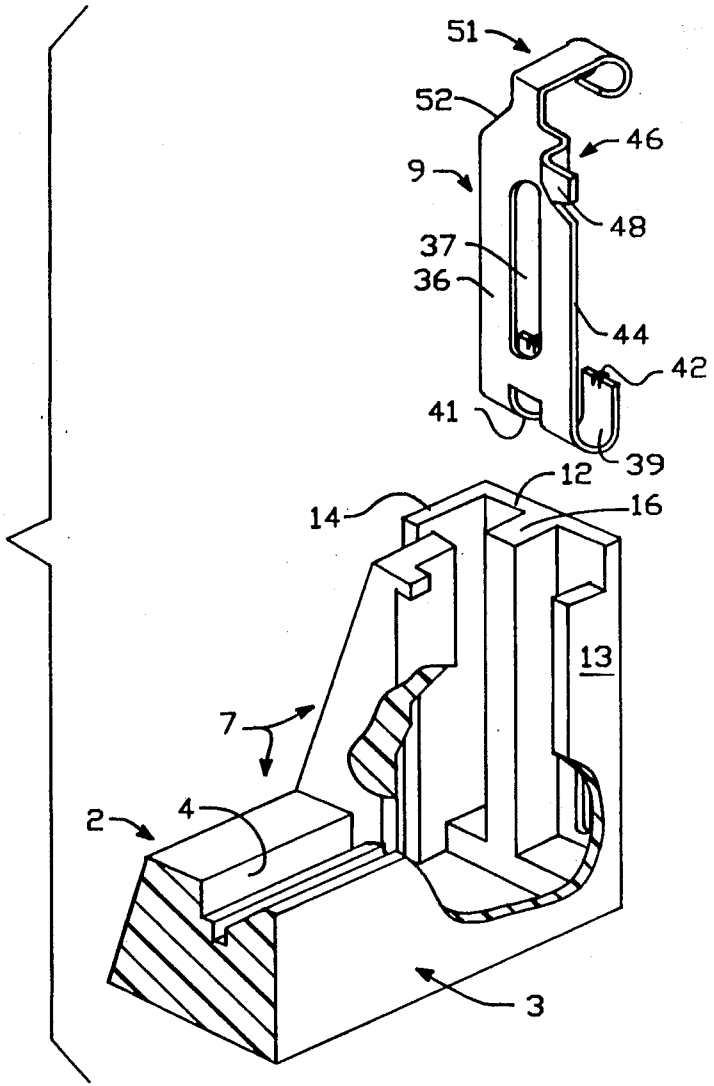
FIG. 1 is a fragmentary composite perspective view illustrating one end portion of a connector member for a single in-line memory module and an inherently resilient metallic latch member disposed thereabove in position for of insertion into the nacelle formed in the end portion of the connector member.
Figure 2:
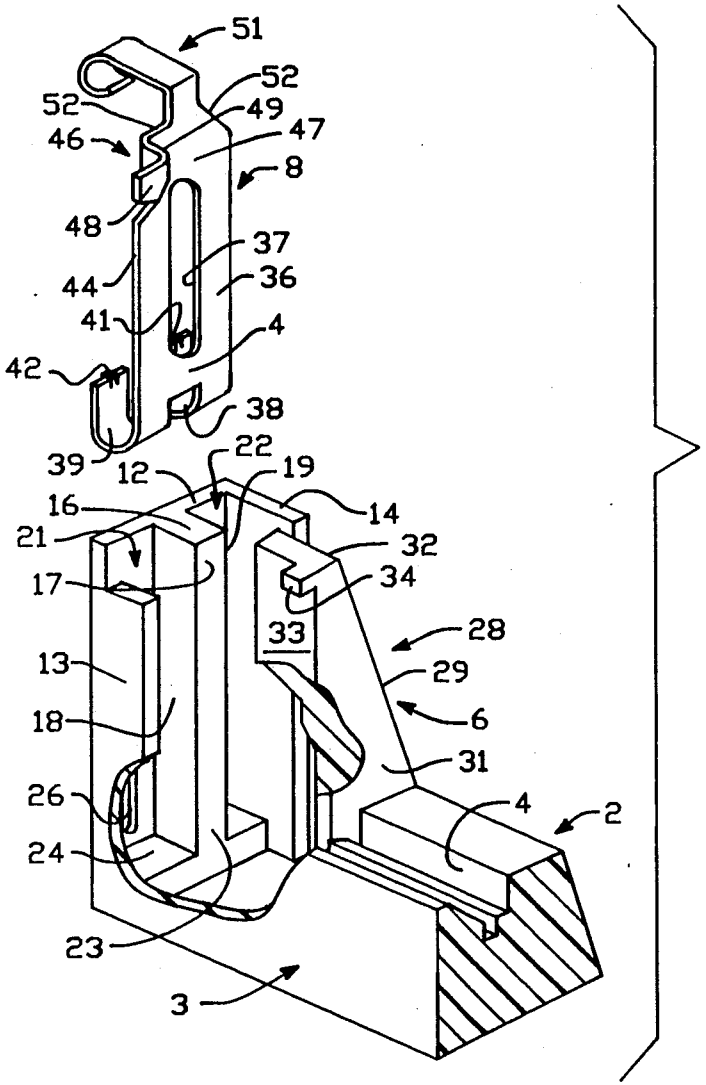
FIG. 2 is a fragmentary composite perspective view similar to FIG. 1, but showing the right end of the connector member and the associated inherently resilient metallic latch prior to insertion into its nacelle.
Figure 3:
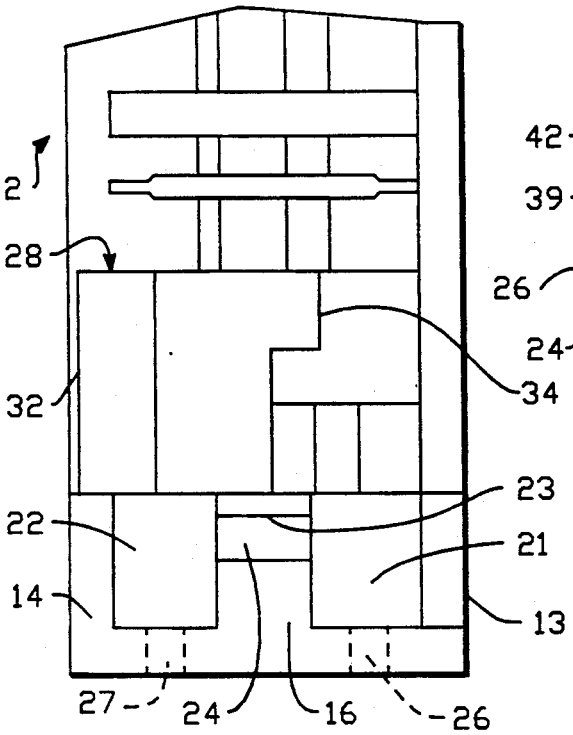
FIG. 3 is a top plan view of the end portion of the connector member shown apart from the latch member.

The subject matter of this invention is related to the end portions of the connector member, and the left end portion designated generally by the numeral 6 is illustrated in FIG. 1. The right end portion is designated generally by the numeral 7 and is illustrated in FIG. 2. Referring to FIG. 1, it will be seen that the end portion 6 of the connector member is adapted to receive a latch member designated generally by the numeral 8, the latch member preferably being fabricated from an appropriate metal having a high degree of inherent resilience and which may be fabricated into a relatively complex configuration by mass production means.

Referring to FIG. 2, it will be seen that the right end portion 7 of the connector member is adapted to receive a latch member 9 that constitutes the mirror image of the latch member 8 associated with the left end of the connector member. The latch member 9 is also fabricated from an appropriate metallic material that has a high degree of inherent resilience for purposes which will hereinafter be explained. Again, in the interest of brevity in this description, only the structure and function of the assembly constituting the left end of the connector member 2 will be explained in detail. However, corresponding reference numbers will be applied to the structure illustrated in FIG. 2 constituting the right end portion of the connector member assembly which is the mirror image of the latch member 8 in the left end portion and performs the same function in relation to the memory module as does the latch member 8, although it is physically positioned at the right end of the connector member.

Referring to FIG. 1, the end portion 6 of the connector member is integrally formed with the elongated central body portion 3, and extends upwardly therefrom in a generally perpendicular relationship to provide an end wall 12 having a width corresponding to the width of the central body portion 3, and extends upwardly therefrom to provide an abutment for the memory module a will hereinafter be explained.

As illustrated in FIG. 1, the end wall 12 of the end portion 6 of the connector member constitutes a web joined integrally along each longitudinal edge by first and second side walls 13 and 14 cooperating with the end wall 12 to form a channel opening toward the central body portion 3 of the connector member. As illustrated, the side wall 14 extends the full height of the end wall 12, while the side wall 13 terminates short of the top edge of the end wall 12. Medianly positioned in the channel formed by end wall 12 and side walls 13 and 14, is an elongated rib designated generally by the numeral 16, having a front face 17, and side surfaces faces 18 and 19 corresponding, respectively, to the side walls 13 and 14. The side surfaces 18 and 19 are generally parallel to the inner surfaces of the side walls 13 and 14, respectively, and the side surfaces of the rib 16 cooperate with the side walls 13 and 14 to form a pair of laterally spaced auxiliary channels 21 and 22 for purposes which will hereinafter be explained.

The front face 17 of the elongated rib tapers from a minimum dimension at the top end of the rib to a maximum dimension at the bottom end 23 ,where the rib is integral with the bottom wall 24 of the nacelle which is of course bifurcated by the intermediate rib 16. Formed in the end wall 12 adjacent the bottom wall 24 and extending upwardly therefrom, and positioned medianly within the auxiliary channels 21 and 22 on opposite sides of the rib 16, are a pair of slots 26 and 27 that cooperate with the latch member 8 to releasably lock the latch member in the nacelle in a manner which will hereinafter be explained.

Also forming an integral part of the end portion 6 of the connector member 2 is an upwardly extending memory module abutment member designated generally by the numeral 28. The abutment member is provided with a rear wall 29 inclined from its base 31 so that the upper rear edge 32 of the abutment member 28 lies within the confines or outline of the side wall 14 if it were extended. The front face 33 of the abutment 28 is perpendicular to the longitudinal axis of the central body portion 3 of the connector member, and is perpendicular also to the transverse dimension of the end wall 12. Projecting from the front face 33 of the abutment member 28 is a memory module positioning lug 34 which cooperates with an aperture in the memory module (not shown) to position the memory module properly within the connector member. The memory module of course is adapted to lie flat against the perpendicular abutment surface 33 and to be retained in such position by the latch member 8 which will now be explained in detail.

Referring again to FIG. 1, it will there be seen that the latch member 8 is fabricated from an elongated strip preferably of an appropriate metal, such as stainless steel, or other suitable materials, including synthetic resinous material, that possesses the requisite amount of inherent resilience to perform the function intended, and which may also be formed by conventional mass production means. As shown, the latch member 8 is fabricated in relation to a longitudinal axis, and includes an intermediate body portion 36 extending along the longitudinal axis and provided with a centrally disposed longitudinally extending slot 37 provided to control the degree of inherent resilience of the latch member. At its lower end, the body portion is bifurcated by a slot 38 to form two laterally spaced parallel resilient fingers 39 and 41 that are circularly bent around in a generally inverted U-shaped configuration as shown to provide upwardly extending and laterally spaced resilient fingers 39 and 41. U-shaped fingers 39 and 41 include resilient bight portions 80 and 82, respectively. The upper ends of the fingers are provided with locking tangs 42 struck from the upper edge portions of the two laterally spaced resilient fingers.

It should be noted that the slot 38 formed in the end portion of the body 36 of the metallic strip is separated from the slot 37 formed in the intermediate body portion by a web portion 43, and that the slot 38 extends upwardly into the main body 36 of the latch member a finite distance beyond commencement of the bend of the bifurcated fingers 39 and 41. Also, it should be noted that the width of the slot 38 is gauged to snugly accommodate the width of the elongated rib 16 when the latch member 8 is inserted into the nacelle formed in the end portion 6 to receive it.

The upper end portion of the latch member 8, along one lateral edge 44, is provided with a lock tab designated generally by the numeral 46, and including a portion of the metal of the strip struck so as to project the lock tab forwardly from the surface 47 of the strip to provide an inclined cam surface 48 and a perpendicular memory module lock surface 49. Thus, the cam surface 48 lies forwardly of the plane of the surface 47, and is inclined thereto so that when a memory module is displaced inwardly for insertion into the connector member, the ends of the memory module abut the inclined surfaces 48 and "cam" the resilient latch members 8 and 9 apart, i.e., away from each other, sufficiently to permit the memory module to lie flat against the face 33 of the abutment member 28. When the memory module has reached this position, the front face of the memory module has aligned itself in the same plane with the plane of the lock surface 49 of the lock tab 46. As a result, the inherent resilience of the latch material causes the latch members 8 and 9 to now move toward each other, the flat surface 49 of each of the tab members 46 overlapping the front face of the memory module so as to reliably lock the memory module in its installed position.

One of the problems that has arisen with regard to the removal of memory modules from connector members such as the one disclosed, is the difficulty of unlatching the memory module to permit its removal. The difficulty of unlatching arises because most latch members of conventional connector members are integrally molded with the connector member, are restricted in size to conserve space, and extend outwardly only sufficiently to latch the memory module without providing a means by which they may be flexed apart to unlatch the memory module. Accordingly, this invention provides a latch lever designated generally by the numeral 51 and constituting a narrowed extension of the main body 36 of the latch member, projecting laterally or angularly from the shoulders 52 in a rearward direction from the top end portion of the latch body 36, so that all that is required to flex the body 36 of the latch member is to press downwardly outwardly on the latch lever 51. Since the latch lever is, essentially, a cantilever beam integral at its root with the main body portion 36, a downward applied force on the latch lever imposes a bending moment on the main body 36, and this affects resilient flexing of the body 36 and retracts the lock surface 49 from contact with the front face of the memory module, thus permitting the memory module to be resiliently projected from the elongated socket slot in the connector body 3 by the resilience of the contact members mounted therealong.

As indicated previously, there are two latch members 8 and 9 associated with each connector member 2. It will of course be understood that the central body portion 3 of the connector member 2 is elongated and integral between the two end portions 6 and 7, and that the right end of the connector member is provided with the same features as the left end of the connector member with the exception that they are configured to receive the latch member 9 which, as previously stated, constitutes the mirror image of the latch member 8.

Figure 5A:
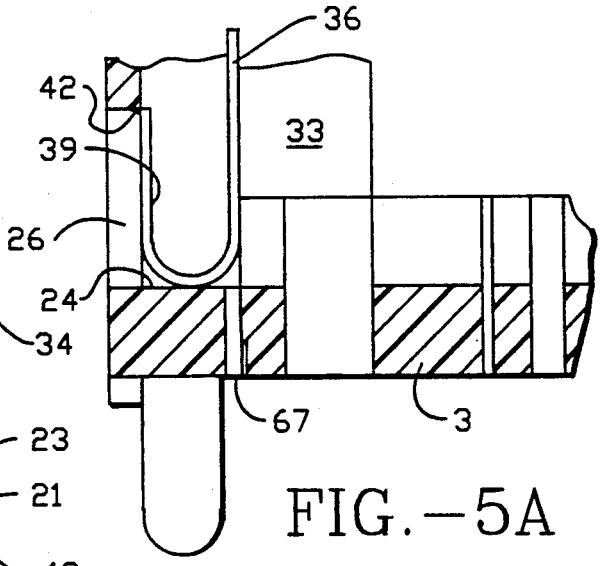
FIG. 5A is a fragmentary elevational view partly in vertical section of a different embodiment of the end portion of the connector member adapted to receive different types of metallic latch members.
Figure 4:
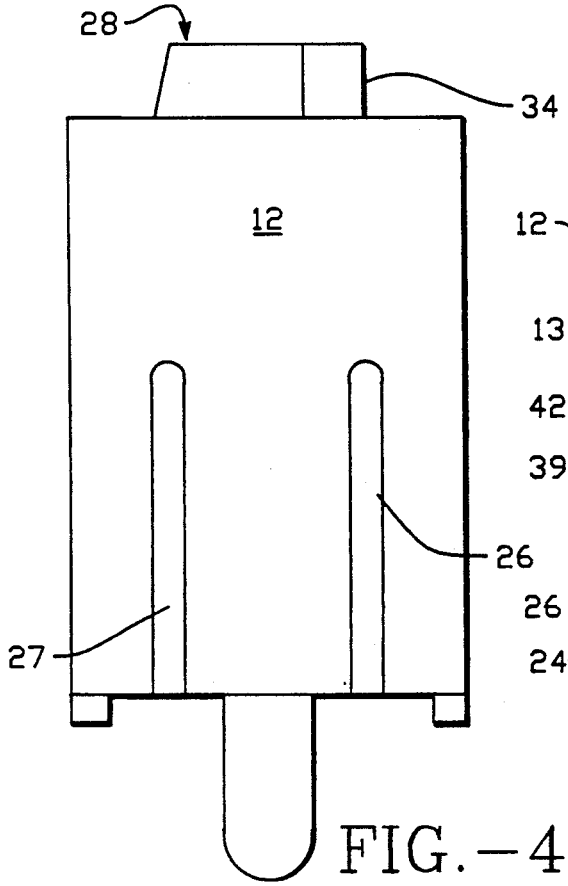
FIG. 4 is an end elevational view of the connector member shown apart from the latch member.
Figure 5:
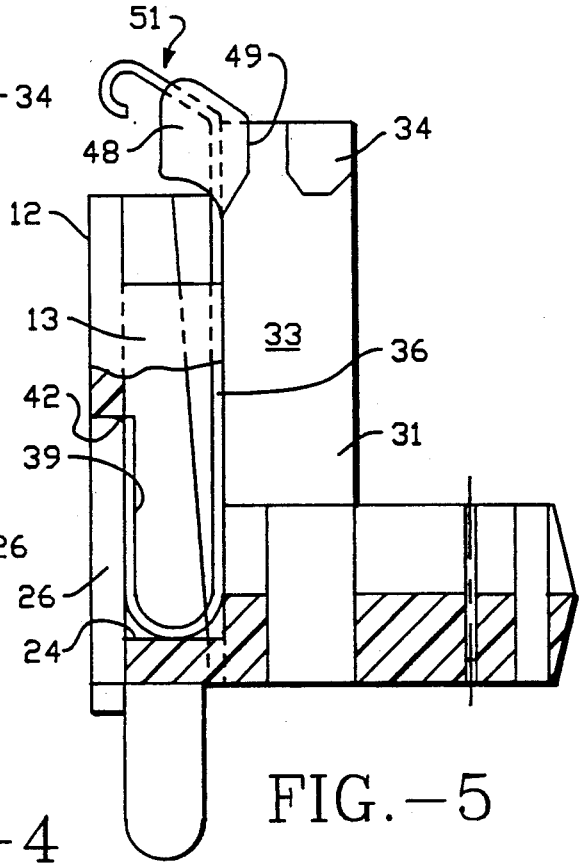
FIG. 5 is a fragmentary elevational view partly in vertical section of the left end portion of the connector member shown with the inherently resilient latch member mounted therein.
Figure 10:
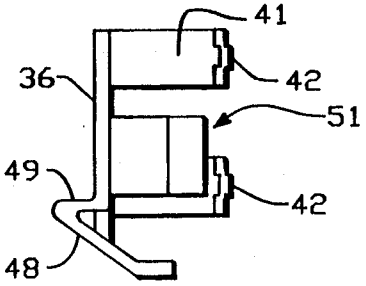
FIG. 10 is a top plan view of the inherently resilient latch member illustrated in FIG. 9.
Figure 9:
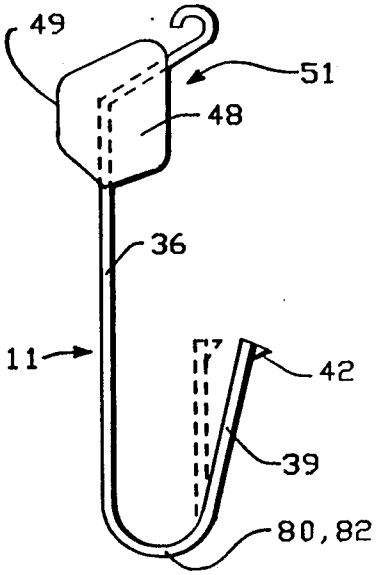
FIG. 9 is an edge elevational view of the inherently resilient latch member adapted for mounting in the opposite or right end of the connector body, the latch member illustrated here constituting a mirror image of the latch member illustrated in FIG. 6.
Figure 11:
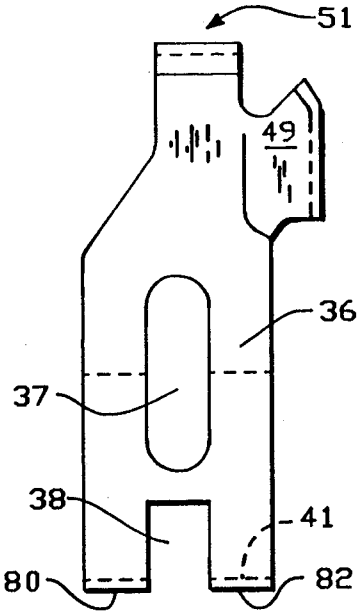
FIG. 11 is an elevational view of the inherently resilient latch member taken in the direction indicated by the arrow 11 in FIG. 9.
Figure 8:
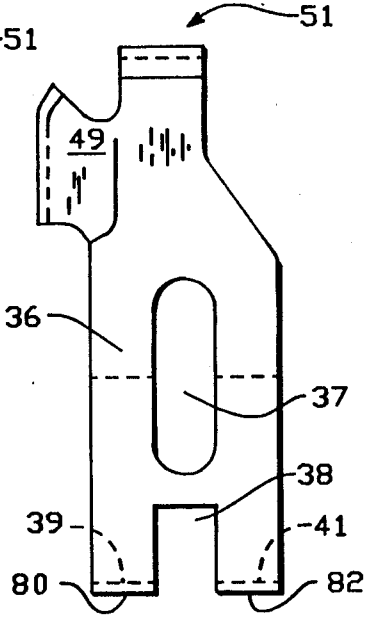
FIG. 8 is an elevational view of the inherently resilient latch member taken in the direction indicated by the arrow 8 in FIG. 6.
Figure 7:
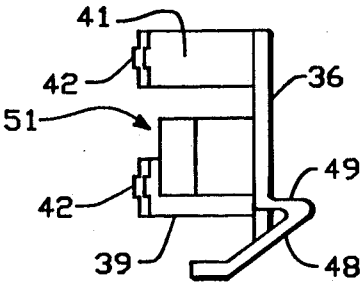
FIG. 7 is a top plan view of the latch member illustrated in FIG. 6.
Figure 6:
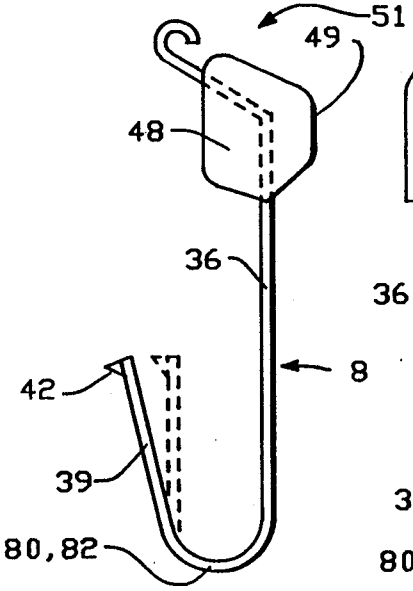
FIG. 6 is an edge elevational view of one embodiment of the latch member shown apart from the connector member.

Referring now to FIGS. 6 and 9, it will be seen that the bifurcated lower end portion of the main body portion 36 provides resilient fingers 39 and 41 of the latch member 8. When apart from the connector member, these resilient fingers are sprung outwardly from the body portion 36 as shown in full lines. When the latch members 8 and 9 are inserted into their respective nacelles, the body portion 36 of each of the latch members abuts against the associated surface of the abutment member 28, while the resilient laterally spaced fingers 39 and 41 are resiliently cammed inwardly broken line position by the inside surface of wall 12 of the channels 21 and 22 against which the fingers impinge. Continued insertion of the resilient latch members 8 and 9 into their final position as illustrated in FIG. 5 results in the lock tangs 42 projecting into the associated slots 26 and 27 formed in the end wall 12. The lock tangs 42 abut the upper end of the slot and thus releasably lock the resilient latch member in position within the associated nacelle.

It should be noted that in the installed position of the resilient latch members in their respective nacelles that the slot 38 that separates the two resilient fingers is arranged so that the resilient fingers 39 and 41 straddle the central rib 16, thus preventing twisting or rotation of the body portion 36 of the latch member when the memory module is inserted and the ends thereof forcefully cam the resilient latch member outwardly to accommodate the memory module as previously discussed. It will thus be seen that all that is required to release a memory module from the connector member is to simultaneously depress the latch levers 51, each of which constitutes an angularly diposed cantilever beam projecting from the end of the main body 36 of the latch member. Such downward force imposes a bending moment on the inherently resilient body 36 of the latch member, causing it to be displaced outwardly away from the ends of the memory module, and thus causing the lock surfaces 49 to disengage from the front face of the memory module, resulting in the memory module being resiliently ejected from the socket in which it is normally retained.

It should also be noted that such downward imposition of a force on the cantilever latch lever 51 imposes a downward force on the connector member, ths avoiding any stresses that might otherwise be imposed on the union between the connector member and the printed circuit board on which it is mounted. Additionally, it should be noted that the tapered or inclined front face 17 of the central rib 16 at its upper end, being less thick than at its base, provides the clearance that is necessary to permit the upper portion of the resilient latch member to be displaced away from the abutment member 28 to thus enable the memory module to be unlatched from the connector member.

While it is intended that the latch members 8 and 9 be securely mounted in the respective end portions of the connector member, and such purpose is effected by the latch tangs 42 engaging the tops of slots 26 and 27, nevertheless, with an appropriate tool extending through the slots 26 and 27, the upper ends of spring fingers 39 and 41 may be displaced inwardly so as to disengage the lock tangs 42 from the top of the respective slots, thus enabling the latch member to be extracted from the nacelle within which it is seated.

Referring to FIG. 12, there is there illustrated a second embodiment of the latch member, here designated generally by the numeral 56 and being quite similar to the latch members 8 and with the exception that in this embodiment the U-shaped resilient fingers of the previous embodiment have been replaced by fingers 57 and 58 formed to project perpendicularly from the bottom end of the main body portion 36 and perform the triple function of stop and positioning tabs and control of resilience. The fingers 57 and 58 are spaced apart in the same manner that the resilient fingers 39 and 41, but in this embodiment, the lateral spacing is formed by the short radius bending of the tabs or fingers 57–58 out of the plane of the main body 36 while leaving the central portion as a downwardly projecting lock tine or tongue 59 from the surface of which is struck a lock tang or abutment 61 which projects out of the plane of the tine 59. In every other respect, the latch member 56 is identical to the latch member 8, and is of course complemented by a mirror image latch member (not shown) adapted to be inserted into the opposite end of the connector member for which it is designed.

In this respect, and referring to FIGS. 13 through 16, particularly FIG. 16, it will be seen from this view that the latch member 56 has been inserted into the nacelle 21–22 formed in the associated left end portion of the connector member, here designated generally by the numeral 62. Comparing the end portion 62 of FIG. 16 with the end portion 6 shown in FIG. 5, it will be seen that the bottom 63 of the nacelle 21–22 has been elevated in this embodiment illustrated in FIG. 16 so as to form a floor against which the laterally extending fingers 57 and 58 may abut to limit insertion of the latch member. The extreme ends of the fingers snugly abut the associated inside surfaces of the nacelle channels 21 and 22 to properly position the main body portion 36 against the associated side surface of the abutment member 28. Since the fingers 57–58 straddle the rib 16 at its base, the latch member is prevented from twisting or rotating, while being resiliently diplaceable to the left as viewed in FIG. 16.

Additionally, in this embodiment, the slots 26 and 27 may or may not be provided in the end wall 12, which is here shown with such slots eliminated. A further modification of the end portion 62 as compared to the end portion 6 is the provision of a slot 64 through the bottom wall of the connector member into which the tine 59 extending from the main body portion 36 of the latch member may project as shown. The slot 64 is provided with a rabbet or recess 66 providing a shoulder in the slot 64 against which the upper end of the lock tang 61 may impinge when the tine 59 is inserted into the slot 64. Thus, the latch member 56 lies securely nested within the nacelle 21–22 formed by the rear wall 12 and the inwardly projecting side wall members 13 and 14. Again, while the latch member 56 may be considered to be permanently mounted in the end portion 62 of the connector member, it will be noted that an appropriate tool may be inserted into the rabbetted notch or recess 66 behind the lock tang 61, to flex the tang inwardly into the plane of the tine 59 so as to permit removal of the latch member should that become necessary. It may be noted that the connector end portion 6 as illustrated in FIG. 5 could be rendered universally cooperative with either latch member 8(*a*) or 56 by the addition of a slot 67 as illustrated in the modified end portion 6A illustrated in FIG. 5A.

Figure 17:
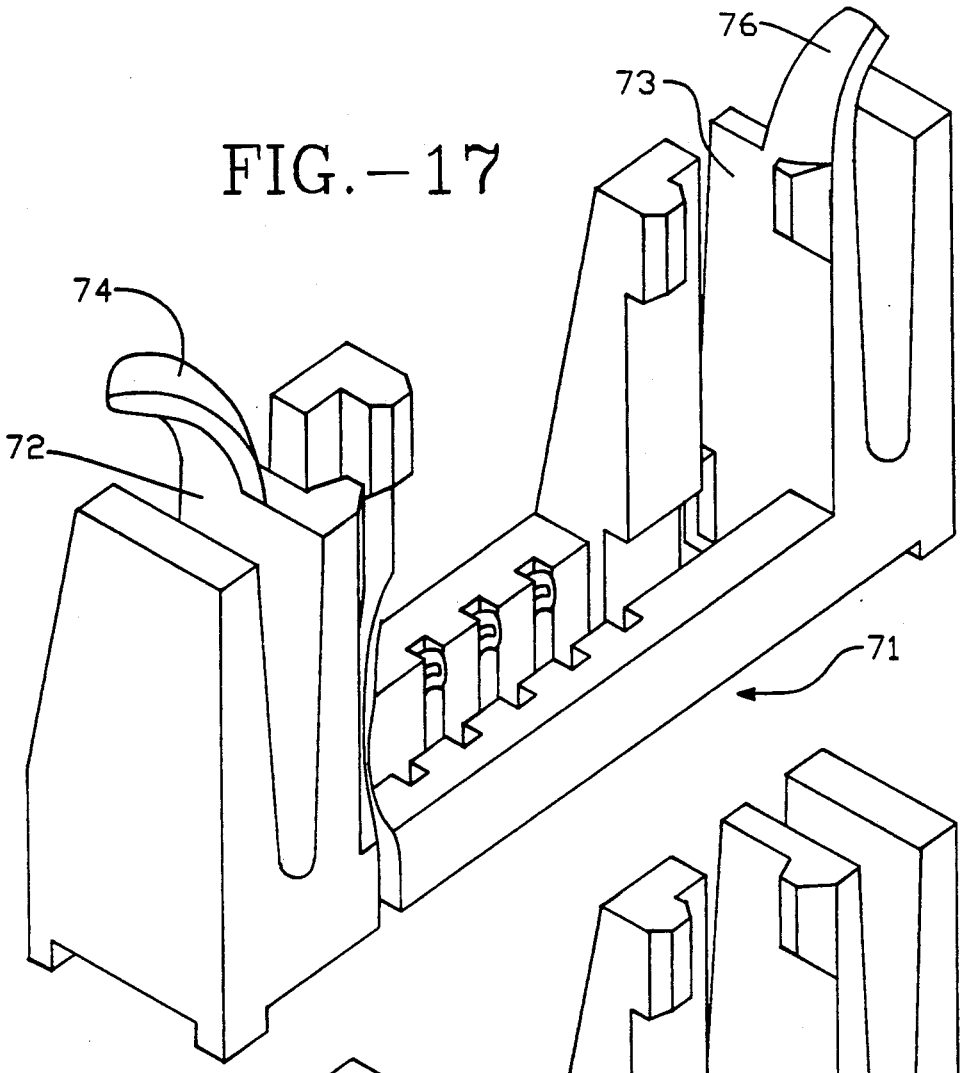
FIG. 17 is a perspective view of a monolithic connector member molded in plastic and incorporating integral plastic latch members at opposite ends of the connector member equipped with latch levers to facilitate removal of the memory module.

While the embodiment of the invention illustrated in FIGS. 1 through 16 relate to the application of an inherently resilient metallic latch member to an injection molded synthetic resinous end portion of a connector member, the embodiment of the invention illustrated in FIG. 17 differs significantly from the forgoing embodiments in that the latch members that retain the memory module engaged within the connector member are integrally formed with the connector member by injection molding, but incorporate a means for facilitating actuation of the latch members so as to release a memory module from the connector member.

In this regard, reference is made to FIG. 17, wherein the connector member, designated generally by the numeral 71, is illustrated as being similar to the connector member illustrated in FIG. 1 of U.S. Pat. No. 4,832,617, with the exception that the latch members 72 and 73, each of which is integrally formed with the connector member 71, include outwardly extending latch levers 74 and 76 associated, respectively, with the left and right end portions of the connector member as illustrated. The addition of these latch levers 74 and 76 constitutes the addition of an integral angularly extending cantilever beam to the top portion of each of the latch levers, and enables the application of a downwardly applied force on the latch levers 74 and 76 to impose a bending moment on the latch members to effect outward flexure of the latch member 72 and 73 to release the memory module.

Figure 18:
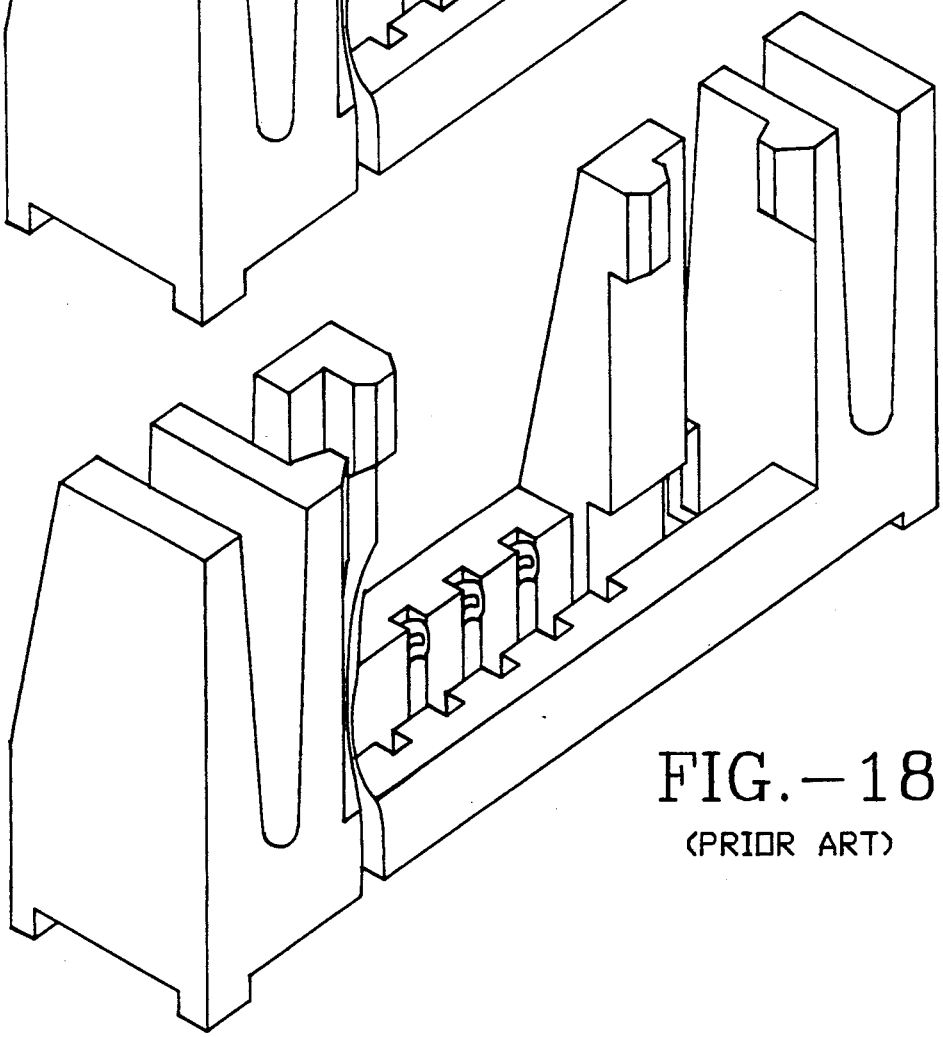
FIG.-18 (PRIOR ART)
FIG. 18 is a perspective view of the monolithic connector of FIG. 17 prior to incorporation of the latch levers on the latch members and constituting a prior art structure.

In the prior art connector member illustrated in FIG. 18, it will be seen that when the memory module is inserted into the connector member, only one very small corner of each latch member is available against which an outwardly, i.e., longitudinally, directed force may be applied to effect displacement of the latch member and resulting disengagement of the latch lugs from the face of the memory module. It has been found that the application of such force to such a limited area is accomplished with great difficulty and imposes the risk of the tool slipping from the corner of the latch member and impinging against closely adjacent connector members and/or the memory modules mounted therein. Accordingly, it will be clear that while the addition of cantilever-type latch levers 74 and 76 may appear to be quite simple in concept and in structure, nevertheless, they provide a surprising degree of facility for removal of the memory module not heretofore available or known.

We claim:

1. As an article of manufacture, a latch member adapted to be mounted on one end of a connector member for retaining the associated end of an in-line memory module operatively seated in the connector member, said latch member comprising:

a) a main body portion constituting an intermediate section of an elongated inherently resilient metallic strip including first and second opposite end portions integral with said main body portion, the width of said main body portion further is defined by longitudinally extending laterally spaced first and second parallel edges;

b) a latch lever formed on said first end portion and projecting angularly out of the plane of said main body portion to form a cantilever projection therefrom, said latch lever further projects asymmetrically from said main body portion so that it lies closer to one edge than the other;

c) a latch lug formed on said first end portion adjacent said latch lever and projecting out of the plane of said main body portion in a direction opposite to the direction of projection of said latch lever, said latch lug including a cam surface inclined to said main body portion and a lock surface perpendicular to said main body portion; and d) a pair of laterally spaced fingers formed on said second end portion and extending out of the plane of said main body portion in a direction opposite to said latch lug.

2. As an article of manufacture, a latch member adapted to be mounted on one end of a connector member for retaining the associated end of an in-line memory module operatively seated in the connector member, said latch member comprising:

a) a main body portion constituting an intermediate section of an elongated inherently resilient metallic strip including first and second opposite end portions integral with said main body portion, the width of said elongated metallic strip is defined by longitudinally extending first and second parallel edges;

b) a latch lever formed on said first end portion and projecting angularly out of the plane of said main body portion to form a cantilever projection therefrom;

c) a latch lug formed on said first end portion adjacent said latch lever and projecting out of the plane of said main body portion in a direction opposite to the direction of projection of said latch lever, said latch lug including a cam surface inclined to said main body portion and a lock surface perpendicular to said main body portion, said latch lug is further formed adjacent one edge so that said lock surface lies intermediate said first and second edges and said cam surface extends laterally from said lock surface to at least the said one edge; and d) a pair of laterally spaced fingers formed on said second end portion and extending out of the plane of said main body portion in a direction opposite to said latch lug.

3. As an article of manufacture, a latch member adapted to be mounted on one end of a connector member for retaining the associated end of an in-line memory module operatively seated in the connector member, said latch member comprising:

a) a main body portion constituting an intermediate section of an elongated inherently resilient metallic strip including first and second opposite end portions integral with said main body portion;

b) a latch lever formed on said first end portion and projecting angularly out of the plane of said main body portion to form a cantilever projection therefrom;

c) a latch lug formed on said first end portion adjacent said latch lever and projecting out of the plane of said main body portion in a direction opposite to the direction of projection of said latch lever, said latch lug including a cam surface inclined to said main body portion and a lock surface perpendicular to said main body portion; and d) a pair of generally U-shaped laterally spaced fingers formed on said second end portion and extending out of the plane of said main body portion in a direction opposite to said latch lug, one leg of each of said U-shaped laterally spaced fingers is integral with said main body portion and the other leg of each said U-shaped laterally spaced fingers constitutes an inherently resilient member laterally spaced from said main body portion and having a free end portion, and a lock tab on the free end portion of each of said fingers.

4. As an article of manufacture, a latch member adapted to be mounted on one end of a connector member for retaining the associated end of an in-line memory module operatively seated in the connector member, said latch member comprising:

a) a main body portion constituting an intermediate section of an elongated inherently resilient metallic strip including first and second opposite end portions integral with said main body portion;

b) a latch lever formed on said first end portion and projecting angularly out of the plane of said main body portion to form a cantilever projection therefrom;

c) a latch lug formed on said first end portion adjacent said latch lever and projecting out of the plane of said main body portion in a direction opposite to the direction of projection of said latch lever, said latch lug including a cam surface inclined to said main body portion and a lock surface perpendicular to said main body portion;

d) a pair of laterally spaced fingers formed on said second end portion and extending out of the plane of said main body portion in a direction opposite to said latch lug and further extending substantially perpendicular to said main body portion;

e) a tine extends from said second end portion in the plane of said main body portion and projects substantially perpendicularly past the plane of said pair of laterally spaced flanges; and f) a tang on said tine projecting out of the plane of said tine to provide an abutment thereon.

5. A connector member of the type adapted for mounting on a printed circuit board and forming a socket having a series of resilient contact fingers adapted to operatively engage the edge contact pads of a single in-line memory module when said memory module board is inserted into said socket, comprising:

a) an elongated intermediate socket portion on which said resilient contact fingers are mounted for resilient impingement on a series of corresponding contact pads on a memory module;

b) integral end portions formed on opposite ends of the intermediate socket portion and each including means cooperating with an associated end portion of a memory module to operatively position the memory module longitudinally in relation to the socket;

c) a latch member on each said integral end portion and including a lock lug having a lock face adapted to impinge against an associated face portion of a memory module to releasably lock said memory module between said end portions; and d) a latch lever on each said latch member extending cantilever-like therefrom and manipulable to impose a bending moment on said latch member to effect displacement of said lock lug and release of said memory module from said connector member.

6. The connector member according to claim 5, wherein said elongated intermediate socket portion and said integral end portions are formed from synthetic resinous material, and said latch member is formed integrally with the associated integral end portion.

7. The connector member according to claim 5, wherein said elongated intermediate socket portion and said integral end portions are formed from synthetic resinous material, and said latch member is formed from an inherently resilient metal.

8. The connector member according to claim 5, wherein each said integral end portion includes a channel member extending perpendicularly from and integral with an associated end of said elongated intermediate socket portion to form a nacelle into which said latch member i inserted, and means on said latch member operatively cooperating with said connector member to releasably lock the latch member within the nacelle.

9. The connector member according to claim 8, wherein said channel member includes an end wall and laterally spaced parallel side walls, an elongated rib formed medianly within said channel member, and said latch member includes a bifurcated end portion providing laterally spaced fingers straddling said elongated rib.

10. The connector member according to claim 9, wherein the end wall of said channel member is provided with a pair of laterally spaced slots, and lock lugs are provided on said spaced fingers engaging said slots to releasably lock the latch member to the associated end portion.

11. The connector member according to claim 8, wherein said nacelle possesses a bottom wall, a slot formed in said bottom wall, and said means on said latch member to releasably lock the latch member within the nacelle comprises a tine engageably extending into said slot.

12. The connector member according to claim 7, wherein each said integral end portion includes a channel member extending perpendicularly from and integral with an associated end of said elongated intermediate socket portion, and said inherently resilient metal latch member is mounted on said integral end portion between said channel member and said means cooperating with an associated end of said memory module to operatively position the memory module in the socket.

13. The connector member according to claim 12, wherein said latch member includes first and second end portions, said second end portion being bifurcated to provide a pair of laterally spaced U-shaped fingers one portion of each of which is resiliently biased into engagement with said channel member and the other portion of which is integral with said end portion and is resiliently biased into engagement with said means for operatively positioning the memory module board in the socket.

14. An apparatus for releasably securing an in-line integrated circuit memory module comprising:

a) a pair of complementary latches each including, 1) a main body portion constituting an intermediate section, said main body being substantially resilient, 2) a latch lever coupled to a top portion of said main body and projecting angularly outward from said main body to form a cantilever projection therefrom.

3) a latch lug formed adjacent to said latch lever and projecting away from said latch lever and said main body portion, said latch lug including a cam surface inclined relative to said main body portion and a lock surface substantially perpendicular to said main body portion, 4) at least two laterally spaced fingers extending angularly away from a lower end of said main body such that distal portions of said fingers are disposed substantially opposite said main body;

b) an in-line housing defining an elongated longitudinal socket slot and including a pair of respective pockets positioned at opposite ends of the socket slot, said pair of respective pockets each including a respective end wall and a respective rib member upstanding from the respective wall and extending in a direction substantially perpendicular to the socket slot, each respective rib member separating respective channels within a respective pocket, wherein said respective channels are dimensioned to slidably receive fingers of one of the complementary latches and each of said respective rib members are dimensioned to interfit between the spaced fingers of one of the complementary latches.

15. The apparatus as defined in claim 14 wherein, each respective lateral finger includes at least one respective barb formed at a distal portion thereof.

16. The apparatus as defined in claim 14 wherein, each of said channels define at least one recess; and said respective lateral finger includes at least one respective barb formed at a distal portion thereof, said barbs engaging with said recesses to fixedly mount said latch in said pocket.

17. The apparatus as defined in claim 14 wherein, an upper portion of each upstanding rib member includes a stop surface which limits bending of said main body when a bending force is applied to said latch lever.

18. The apparatus as defined in claim 17 wherein, each of the respective rib members is tapered such that bottom portions of the respective ribs upstand further from the respective walls than do top portions.

19. An assembly for releasably securing an in-line integrated circuit memory module comprising:

a respective first latch and a respective second latch, each of said respective latches including a respective first arm, a respective second arm and a respective resilient bight connecting said respective first arm to said respective second arm such that said respective first arm and said respective second arm are spaced apart by a prescribed distance when said respective bight is in a relaxed state; and an in-line housing defining an elongated slot, and defining a first pocket disposed at one end the slot and a second pocket disposed at an opposite end of the slot, each of the respective pockets including a respective front wall, a respective opposing back wall and a respective rib upstanding from the respective back wall and extending toward the slot, each respective rib dividing the respective pocket into two respective channels;

wherein the respective front wall of the first pocket is spaced apart from the respective back wall of the first pocket such that when said first latch is inserted into the first pocket the respective bight of said first latch is compressed and the respective first and second arms of said first latch are spaced closer together than the prescribed distance and the respective bight of said first latch urges the respective first arm of said first latch into forcible contact with the respective front wall of the first pocket and urges the respective second arm of said first latch into forcible contact with the respective back wall of the first pocket; and wherein the respective front wall of the second pocket is spaced apart from the respective back wall of the second pocket such that when said second latch is inserted into the second pocket the respective bight of said second latch is compressed and the respective first and second arms of said second latch are spaced closer together than the prescribed distance and the respective bight of said second latch urges the respective first arm of said second latch into forcible contact with the respective front wall of the second pocket and urges the respective second arm of said second latch into forcible contact with the respective back wall of the second pocket.

20. The apparatus as defined in claim 19 and further including:

a respective cantilever lever extending from the respective first arm of said first latch; and a respective cantilever lever extending from the respective first arm of said second latch.

21. The apparatus as defined in claim 19 and further including, a respective cantilever lever extending from the respective first arm of said first latch;

a respective lug extending from the respective first arm of said first latch, said respective lug including a respective cam surface inclined relative to the respective first arm of said first latch and a respective lock surface substantially perpendicular to the respective first arm of said first latch;

a respective cantilever lever extending from the respective first arm of said second latch; and a respective lug extending from the respective first arm of said second latch, said respective lug including a respective cam surface latch, said respective lug including a respective cam surface inclined relative to the respective first arm of said second latch and a respective lock surface substantially perpendicular to the respective first arm of said second latch.

22. The apparatus as defined in claim 19 wherein, said respective second arm of said first latch comprises at least two respective laterally spaced fingers; and said respective second arm of said second latch comprises at least two respective laterally spaced fingers.

23. The apparatus as defined in claim 19 wherein, said respective second arm of said first latch comprises at least two respective laterally spaced fingers;

each respective lateral finger of said first latch includes at least one respective barb formed at a distal portion thereof;

said respective second arm of said second latch comprises at least two respective laterally spaced fingers; and each respective lateral finger of said second latch includes at least one respective barb formed at a distal portion thereof.

24. An assembly for releasably securing an in-line integrated circuit memory module comprising:

a respective first latch and a respective second latch, each of said respective latches including a respective first arm, a respective second arm and a respective resilient bight connected said respective first arm to said respective second arm such that said respective first arm and said respective second arm are spaced apart by a prescribed distance when said respective bight is in a relaxed state, each said respective second arm comprising at least two respective laterally spaced fingers; and an in-line housing defining an elongated slot, and defining a first pocket disposed at one end the slot and a second pocket disposed at an opposite end of the slot, each of the respective pockets including a respective front wall, a respective opposing back wall and a respective rib upstanding from the respective back wall and extending toward the slot;

wherein the respective front wall of the first pocket is spaced apart from the respective back wall of the first pocket such that when said first latch is inserted into the first pocket the respective bight of said first latch is compressed and the respective first and second arms of said first latch are spaced closer together than the prescribed distance and the respective bight of said first latch urges the respective first arm of said first latch into forcible contact with the respective front wall of the first pocket and urges the respective second arm of said first latch into forcible contact with the respective back wall of the first pocket, said respective rib of said first pocket being dimensioned to interfit between the respective laterally spaced fingers of the first latch; and wherein the respective front wall of the second pocket is spaced apart from the respective back wall of the second pocket such that when said second latch is inserted into the second pocket the respective bight of said second latch is compressed and the respective first and second arms of said second latch are spaced closer together than the prescribed distance and the respective bight of said second latch urges the respective first arm of said second latch into forcible contact with the respective front wall of the second pocket and urges the respective second arm of said second latch into forcible contact with the respective back wall of the second pocket, said respective rib of said second pocket being dimensioned to interfit between the respective laterally spaced fingers of the second latch.

25. An assembly for releasably securing an in-line integrated circuit memory module comprising:

a respective first latch and a respective second latch, each of said respective latches including a respective first arm, a respective cantilever extending therefrom a respective second arm to said respective second arm such that said respective first arm to said respective second arm such that said respective first arm and said respective second arm are spaced apart by a prescribed distance when said respective bight is in a relaxed state; and an in-line housing defining an elongated sot, and defining a first pocket disposed at one end the slot and a second pocket disposed at an opposite end of the slot, each of the respective pockets including a respective front wall, a respective opposing back wall and a respective rib upstanding from the respective back wall and extending toward the slot, each said respective rib includes a respective stop surface proximate its respective upper portion;

wherein the respective front wall of the first pocket is spaced apart from the respective back wall of the first pocket such that when said first latch is inserted into the first pocket the respective bight of said first latch is compressed and the respective first and second arms of said first latch are spaced closer together than the prescribed distance and the respective bight of said first latch urges the respective first arm of said first latch into forcible contact with the respective front wall of the first pocket and urges the respective second arm of said first latch into forcible contact with the respective back wall of the first pocket, said respective stop portion of said first latch limits bending of said respective resilient bight of said first latch when a first bending force is applied to said respective cantilever lever; and wherein the respective front wall of the second pocket is spaced apart from the respective back wall of the second pocket such that when said second latch is inserted into the second pocket the respective bight of said second latch is compressed and the respective first and second arms of said second latch are spaced closer together than the prescribed distance and the respective bight of said second latch urges the respective first arm of said second latch into forcible contact with the respective front wall of the second pocket and urges the respective second arm of said second latch into forcible contact with the respective back wall of the second pocket, said respective stop portion of said second latch limits bending of said respective resilient bight of said second latch when a second bending force is applied to said respective cantilever lever.

* * * * *

UNITED STATES PATENT AND TRADEMARK OFFICE

CERTIFICATE OF CORRECTION

PATENT NO. : 5,112,242

DATED : May 12, 1992

INVENTOR(S) : Conrad Y. Choy and Jack Yu

It is certified that error appears in the above-indentified patent and that said Letters Patent is hereby corrected as shown below:

Column 5, line 12, delete "a" and insert ---as---.

Column 7, line 68, after "member," delete "ths" and insert ---thus---.

Column 9, after line 67, before line 68, "We claim:", insert ---Having thus described the invention, what is believed to be new and novel and sought to be protected by letters patent of the United States is as follows:---.

Column 11, line 53, Claim 4, before "; and" delete "flanges" and insert ---fingers---.

Column 12, line 29, Claim 8, after "member", delete "i" and insert ---is---.

Column 14, lines 55 and 56, Claim 21, delete "latch, said respective lug including a respective cam surface".

UNITED STATES PATENT AND TRADEMARK OFFICE

CERTIFICATE OF CORRECTION

PATENT NO. : 5,112,242

DATED : May 12, 1992

INVENTOR(S) : Conrad Y. Choy and Jack Yu

It is certified that error appears in the above-indentified patent and that said Letters Patent is hereby corrected as shown below:

Column 16, line 10, Claim 25, after "therefrom" insert ---,---.

Column 16, line 10, Claim 25, insert after "arm" ---and a respective resilient bight connecting said respective first arm---.

Column 16, line 16, Claim 25, delete "sot" and insert ---slot---.

Signed and Sealed this

Twenty-fourth Day of August, 1993

Bruce Lehman

*Attest:*

BRUCE LEHMAN

*Attesting Officer*

*Commissioner of Patents and Trademarks*